US005218178A

United States Patent [19]

Peysakhovich

[11] Patent Number: 5,218,178

[45] Date of Patent: Jun. 8, 1993

[54] METHOD OF AND APPARATUS FOR INTERNAL HEATING OF SOLID BODIES USING ELECTROMAGNETIC INDUCTION

[75] Inventor: Vitaly Peysakhovich, Moorestown, N.J.

[73] Assignee: Inductotherm Corp., Rancocas, N.J.

[21] Appl. No.: 723,868

[22] Filed: Jul. 1, 1991

[51] Int. Cl.[5] ..... H05B 6/40

[52] U.S. Cl. ..... 219/10.43; 219/10.491; 219/10.67; 148/574; 148/567; 266/129

[58] Field of Search ..... 219/10.43, 10.491, 10.67, 219/10.75, 7.5; 148/567, 572, 574, 575; 266/129, 124, 109

[56] References Cited

U.S. PATENT DOCUMENTS

| | | | |
|---|---|---|---|
| 2,144,886 | 1/1939 | Mars et al. . | |
| 2,188,569 | 1/1940 | Endsley | 148/10 |
| 2,615,286 | 10/1952 | Descarsin | 49/50 |
| 2,888,506 | 5/1959 | Harris . | |
| 3,466,202 | 9/1969 | Hrusovsky | 148/567 |
| 3,620,289 | 11/1971 | Phipps, Jr. | 219/10.491 |
| 4,523,067 | 6/1985 | Brown et al. | 219/10.491 |
| 4,579,080 | 4/1986 | Martin et al. | 219/10.67 |
| 4,639,567 | 1/1987 | Stenzel | 219/10.43 |

*Primary Examiner*—Philip H. Leung

*Attorney, Agent, or Firm*—Seidel, Gonda, Lavorgna & Monaco

[57] ABSTRACT

Method and apparatus for internally heating solid bodies using electromagnetic induction. The method comprises generating an electromagnetic induction field and causing it to induce the flow of an electric current in a preselected portion of a solid body to be heated. The electric current has a direction and magnitude sufficient to cause internal heating of the preselected portion of the body. The induction field and the body are rotated relative to one another for causing the direction of the induced current to rotate relative to the body about a preselected location to cause overheating at the preselected location. The body is cooled, except for the preselected portion to be heated. The apparatus comprises a coil for generating an electromagnetic induction field for inducing the flow of an electric current in a preselected portion of a solid body to be heated. The electric current has a direction and magnitude sufficient to cause internal heating of the preselected portion of the body. The apparatus includes a turntable for rotating the induction field and the body relative to one another to cause the direction of flow of the induced current to rotate relative to the body about a preselected location to cause overheating at the preselected location, and a cooling system for cooling the body except for the preselected portion to be heated.

4 Claims, 2 Drawing Sheets

METHOD OF AND APPARATUS FOR INTERNAL HEATING OF SOLID BODIES USING ELECTROMAGNETIC INDUCTION

FIELD OF THE INVENTION

The present invention relates to the field of induction heating and, in particular, to a method and apparatus for internally heating a solid body using electromagnetic induction.

BACKGROUND OF THE INVENTION

It is known in the art of induction heating that a solid body placed in an induction field, such as that generated by an induction coil excited by high-frequency ac current, begins to heat on its surface. The induction field induces electrical currents to flow on the surface of the body. Heating is the result of power dissipated by the currents as they flow against the electrical resistance of the body. The heat generated on the surface of the body can then propagate into the interior of the body. Hence, this known form of induction heating may be thought of as heating the body from the outside in. This property of induction heating is widely used for the heat treatment of metals, for example.

However, it is sometimes desirable to heat the body from the inside out. One application of "inside out" heating is in the melting and refining of metals in a vacuum. Presently, vacuum melting and refining typically requires the metal which is to be melted and refined to be contained in a crucible, usually of a ceramic material. The metal is thus susceptible to contamination from the crucible.

This source of contamination can be eliminated if the metal body itself acts as its own crucible. If the interior of the metal body is heated while the outside of the body is kept cool, i.e., the body is heated from the inside out, the metal will not be forced to contact a containing crucible and, therefore, could be refined in extremely clean conditions.

Typical induction heating apparatus heat from the outside in, and are not suitable for this type of melting and refining. There is thus a need for an induction heating apparatus and method that heats from the inside out. This invention fulfills that need.

SUMMARY OF THE INVENTION

The present invention comprises a method of and apparatus for internally heating solids bodies using electromagnetic induction. The method comprises the steps of generating an electromagnetic induction field, causing the electromagnetic field to induce the flow of an electric current in a preselected portion of a solid body to be heated, the electric current having a direction of flow associated therewith and having a magnitude sufficient to cause internal heating of the preselected portion of the body, rotating the induction field and the solid body relative to one another for causing the direction of flow of the induced current to rotate relative to the solid body about a preselected location within the preselected portion to cause overheating at the preselected location, and cooling the solid body except for the preselected portion to be heated such that substantially only the preselected portion is heated.

The apparatus comprises a coil for generating an electromagnetic induction field for inducing the flow of an electric current in a preselected portion of a solid body to be heated, the electric current having a direction of flow associated therewith and having a magnitude sufficient to cause internal heating of the preselected portion of the body, means for rotating the induction field and the solid body relative to one another to cause the direction of flow of the induced current to rotate relative to the solid body about a preselected location within the preselected portion to cause overheating at the preselected location, and means for cooling the solid body except for the preselected portion to be heated such that substantially only the preselected portion is heated.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
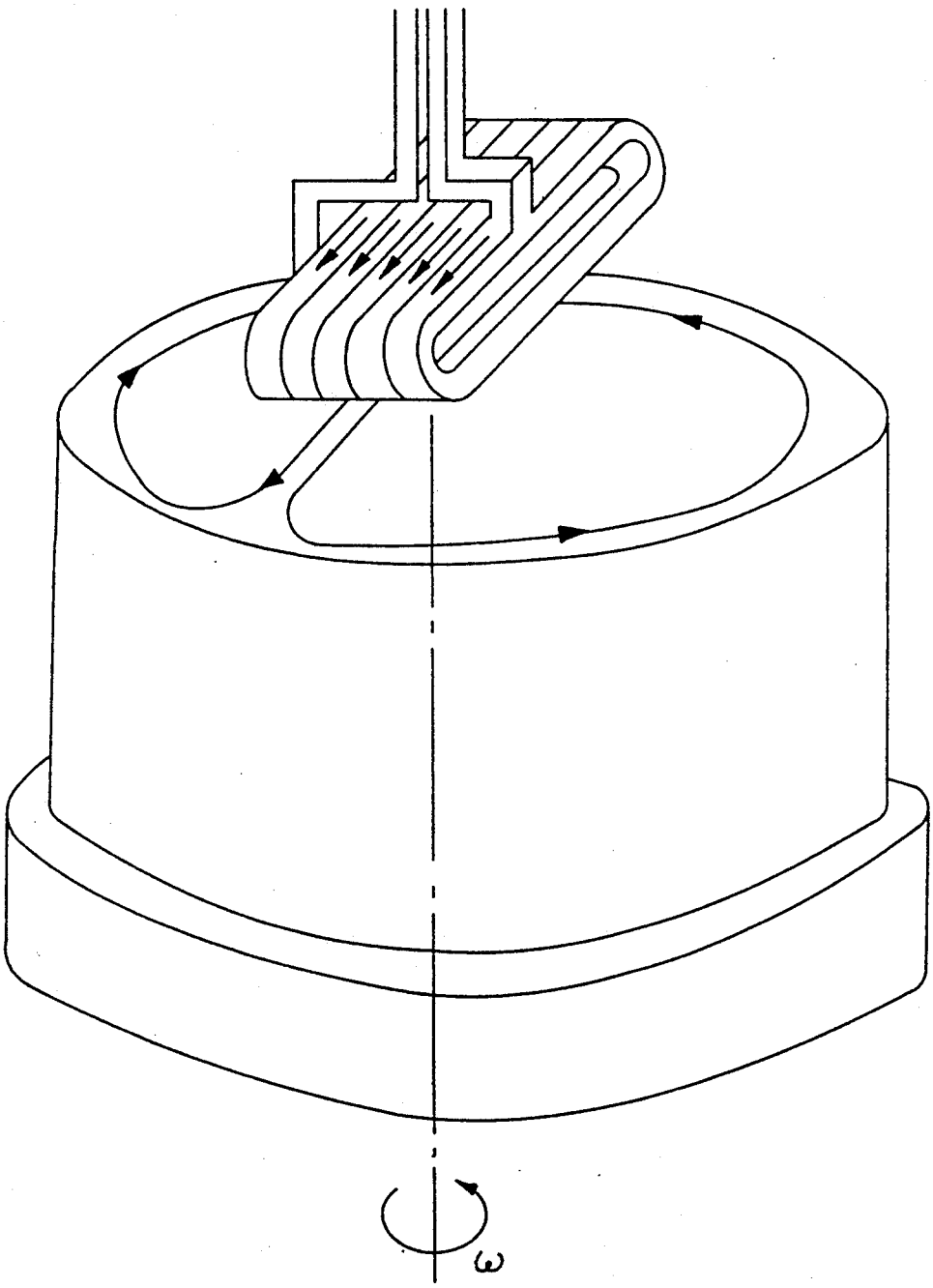
FIG. 1 is a simplified view of a form of apparatus according to the invention and for carrying out the method of the invention.

Referring now to the drawings, wherein like numerals indicate like elements, there is shown in FIG. 1 an apparatus 10 according to and for carrying out the method of the present invention. The apparatus comprises a rotatable support, or base, 12 and an induction coil generally indicated by reference numeral 14. The induction coil 14 has a magnetic core 15.

Base 12 is preferably in the form of a right cylindrical turntable and is rotatable about its axis 16, indicated by the chain line in FIG. 1. Base 12 may be rotated by any suitable means, such as a direct-drive electric motor, a belt and pulley arrangement, a gear arrangement, or the like. The exact manner in which base 12 is rotated is not crucial to the invention, and any suitable means for rotating base 12 can be employed without departing from the invention. Base 12 is rotated at an angular velocity $\omega$. The precise magnitude of angular velocity $\omega$ is not critical to the invention, as long as it is not so great as to cause splashing or scattering of molten metal by centrifugal forces.

Base 12 is preferably cooled to maintain base 12 at a temperature substantially below the melting temperature of the body to be heated and refined. For this purpose, base 12 may be equipped with cooling lines 18 and 20 for admitting and exhausting coolant to and from base 12, respectively. A preferred coolant is water, but other cooling fluids such as air or other liquids can be used. In some cases, where the body to be heated and refined is small, cooling may not be necessary.

Induction coil 14 is generally elongated in a direction perpendicular to axis 16 and comprises at least one turn 22. Coil 14 is exited, in known manner, by a high-frequency ac current. Magnetic core 15 intensifies the magnetic flux generated by coil 14. The current direction in the coil turns for one half-cycle is in the direction illustrated by arrows 24. The current direction for the other half-cycle is, as those skilled in the art will understand, in the opposite direction. The length of coil 14 in the long direction is preferably no greater than the longest dimension of the solid body to be heated. The width of the coil in the transverse direction is determined by the diameter of the preselected portion of the body to be heated. The diameter depends on the ratio between the diameter and height of the metal body and the chosen technology of metal melting. Coil 14 is located coaxially with base 14, so that the centerline of coil 14 lies along axis 16.

A body 26 to be heated and refined is placed on base 12 below induction coil 14. Conveniently, although not necessarily, body 26 is in the form of a right cylinder. The dimensions of body 26, and its exact shape are not critical to the invention. Body 26 may be a rectangular solid, or may have a hexagonal or polygonal cross-section without departing from the scope of the invention. If necessary or desired, base 12 or coil 14, or both, may be movable up and down along axis 16 as required to accommodate body 26.

Coil 14 induces a current 28, represented by arrows, to flow on the top surface, or buttress, 30 of body 26. As those skilled in the art will understand, current 28 will flow in the direction indicated when the current in coil 14 is in the direction shown by arrows 24. Current 28 will change direction and flow in the opposite direction when the current in coil 14 is in the direction opposite to that indicated by arrows 24.

Figure 2:
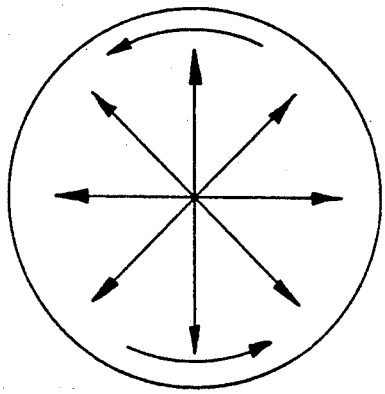
FIG. 2 illustrates the orientation of the induced currents in a solid body when heated by the apparatus and according to the method of the invention.

Since body 26 is being rotated by base 12, the azimuthal orientation of the surface current 28 is constantly changing, as shown in FIG. 2. FIG. 2 depicts a top plan view of buttress 30 of body 26. In FIG. 2, the surface current flowing in buttress 30 is represented as double-headed arrows 32, and the portion of the surface current that flows along the circumference of buttress 30 is omitted from the figure for the sake of clarity. As body 26 is rotated in the direction of arrows 34, the azimuthal direction of the surface currents 32 will likewise rotate relative to buttress 30. However, since the centerline of coil 14 lies along axis 16, all of the current lines 32 will intersect at axis 16. This will result in a very high current density adjacent axis 16, and the current density will decrease radially outwardly from axis 16. Consequently, the center of buttress 30 will overheat and, as long as sufficient power is supplied by the coil 14, will melt. The heat produced at the center of buttress will propagate downward into body 26 and radially outward along the top 30 of body 26, heating and melting a portion of body 26 from the inside out. By cooling base 12, the remaining portions of body 26 are kept below its melting temperature, so that the center of body 26 can melt while being contained by the cool outside surface of body 26.

Figure 3:
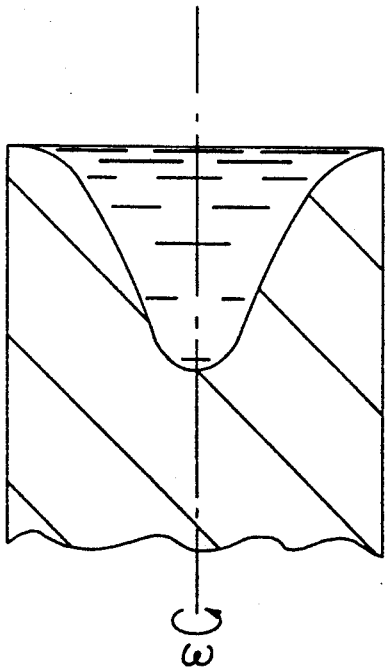
FIG. 3 is a transverse sectional view through a solid body heated by the apparatus and according to the method of the invention.

A typical melting pattern for a cylindrical body is illustrated in FIG. 3. A pool of molten metal 36 is formed in the upper portion of body 26, and the remaining portions of body 26, which are cooled and thus do not melt, contain the molten metal. Thus, the solid portions of body 26 act as a crucible for molten metal 36. However, since molten metal 36 contacts only like metal in the solid portions of body 26, instead of a ceramic crucible, molten metal 36 is not contaminated as it would be by the crucible. Molten metal 36 can therefore be melted and refined to a high degree of purity.

Means for drawing or pouring off molten metal 36 may be provided as desired. For example, base 12 may be tilted to pour off molten metal 36, or body 26 may be lifted and poured separately.

The present invention may be embodied in other specific forms without departing from the spirit or essential attributes thereof and, accordingly, reference should be made to the appended claims, rather than to the foregoing specification, as indicating the scope of the invention.

I claim:

1. Method of internally heating a solid body using electromagnetic induction, comprising the steps of (a) generating an electromagnetic induction field, (b) causing the electromagnetic field to induce the flow of an electric current in a preselected portion of a solid body to be heated, the electric current having a direction of flow associated therewith and having a magnitude sufficient to cause internal heating of the preselected portion of the body, (c) rotating the induction field and the solid body relative to one another for causing the direction of flow of the induced current to rotate relative to the solid body about a preselected location within the preselected portion to cause overheating at the preselected location, and (d) cooling the solid body except for the preselected portion to be heated such that substantially only the preselected portion is heated.

2. Apparatus for internally heating a solid body using electromagnetic induction, comprising (a) means for generating an electromagnetic induction field for inducing the flow of an electric current in a preselected portion of a solid body to be heated, the electric current having a direction of flow associated therewith and having a magnitude sufficient to cause internal heating of the preselected portion of the body, (b) means for rotating the induction field and the solid body relative to one another to cause the direction of flow of the induced current to rotate relative to the solid body about a preselected location within the preselected portion to cause overheating at the preselected location, and (c) means for cooling the solid body except for the preselected portion to be heated such that substantially only the preselected portion is heated.

3. Apparatus according to claim 2, wherein the means for generating an electromagnetic induction field comprises an induction coil having at least one turn.

4. Apparatus according to claim 2, wherein the means for rotating and the means for cooling comprise a cooled rotatable turntable.

* * * * *